US005653919A

United States Patent [19]

White et al.

[11] Patent Number: 5,653,919

[45] Date of Patent: Aug. 5, 1997

[54] HUMIDIFICATION SYSTEM

[75] Inventors: Kenneth P. White, Burlington, N.C.; David B. White, Lewisberry, Pa.

[73] Assignee: Morgan & White, Ltd., Lewisberry, Pa.

[21] Appl. No.: 494,138

[22] Filed: Jun. 23, 1995

[51] Int. Cl.[6] ..... B01F 3/04

[52] U.S. Cl. ..... 261/21; 261/30; 261/81; 261/DIG. 15; 261/DIG. 48; 95/78; 55/260

[58] Field of Search ..... 261/21, 30, 81, 261/DIG. 15, DIG. 48, 23.1, DIG. 34, DIG. 4; 95/78; 55/260, 418, DIG. 37

[56] References Cited

U.S. PATENT DOCUMENTS

| | | | |
|---|---|---|---|
| 1,925,907 | 9/1933 | Norris | 261/DIG. 15 |
| 3,895,926 | 7/1975 | Lerner | 55/260 |
| 4,238,425 | 12/1980 | Matsuoka et al. . | |
| 4,394,139 | 7/1983 | Board | 55/260 |
| 4,564,375 | 1/1986 | Munk et al. . | |
| 4,719,057 | 1/1988 | Mizoguchi . | |
| 4,731,204 | 3/1988 | Noma et al. | 261/DIG. 48 |
| 4,911,866 | 3/1990 | Monroe . | |
| 4,913,856 | 4/1990 | Morton . | |
| 4,921,639 | 5/1990 | Chiu . | |
| 4,986,937 | 1/1991 | Sorio . | |
| 5,030,253 | 7/1991 | Tokuhiro et al. | 261/DIG. 48 |
| 5,407,604 | 4/1995 | Luffman | 261/DIG. 15 |

FOREIGN PATENT DOCUMENTS

| | | | |
|---|---|---|---|
| 3049421 | 7/1982 | Germany | 261/DIG. 48 |
| 4-124536 | 4/1992 | Japan | 261/DIG. 15 |

*Primary Examiner*—Khanh P. Nguyen
*Attorney, Agent, or Firm*—Quarles & Brady

[57] ABSTRACT

A humidifier for adding liquid from a mist source to a gas flow improves the evaporation of the liquid by reducing the quantity of larger water droplets from the mist introduced to the gas flow by slowing a diverted portion of the gas flow, routing the gas flow through a partitioned chamber and deflecting the gas flow from direct impact on the mist while catching splattered liquid droplets within the humidifier.

14 Claims, 3 Drawing Sheets

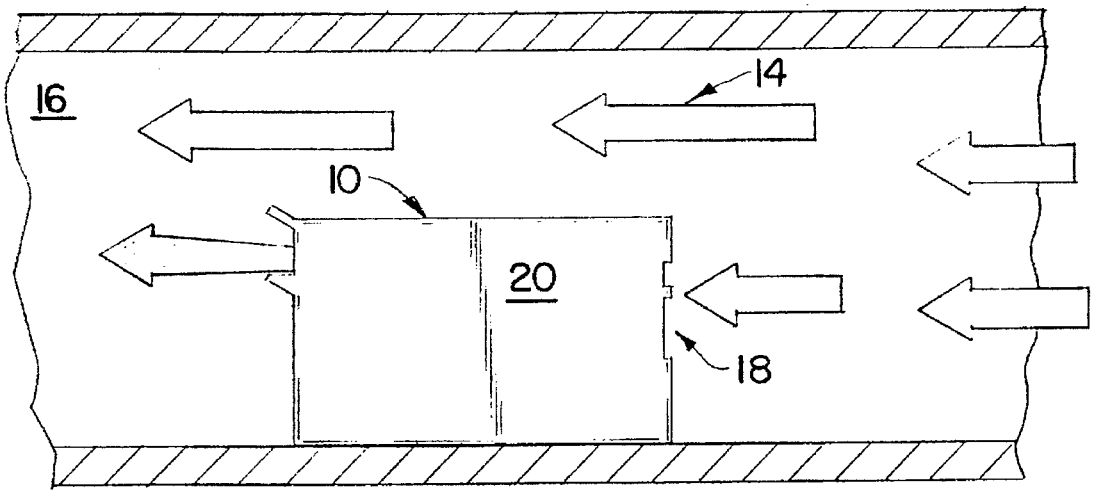
FIG. 3
FIG. 4
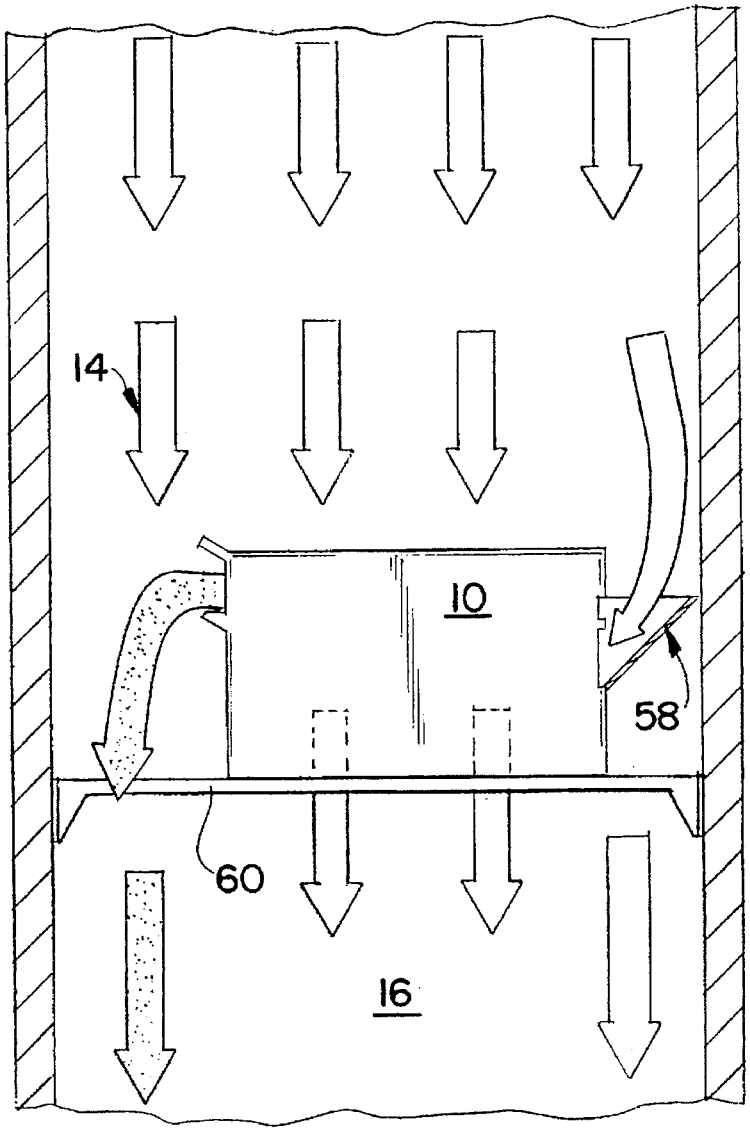

HUMIDIFICATION SYSTEM

FIELD OF THE INVENTION

The invention relates to humidification systems. More particularly, the invention is directed to humidifiers that introduce liquid into a gas stream for evaporation.

BACKGROUND OF THE INVENTION

Humidifiers are used, for example, to introduce a liquid, such as water, to a gaseous medium, such as air, in an air conditioning system. Mist generators or mist sources, such as steam producing heaters, atomizers, nebulizers and ultrasonic vibrators have been used to present liquid in the form of droplets to a passing flow of gas. Many prior systems orient a plurality of mist generators, such as nozzles in rows that are positioned transverse to the air flow. These systems are thus limited by the lateral space parameters of the surrounding duct work or passage.

The prior systems are also limited in the range of air speeds that can be accommodated. Because complete evaporation of the water droplets is a function of the size and quantity of the droplets, some droplets do not completely evaporate before encountering a curve in the duct or passageway in which the gas is flowing. Unevaporated water droplets can collect on the duct work at the curves, causing dripping onto associated ceilings or rooms. This phenomenon is sometimes referred to as raining.

It has been necessary to limit the air speed in humidified systems to avoid or minimize raining. In fact, prior systems have been limited to air speeds of less than 800 feet per minute to allow sufficient time for evaporation of acquired liquid before the flow passes a curve or other transition in the passage.

SUMMARY OF THE INVENTION

It is an object of the invention to provide a humidification system that effectively and efficiently introduces liquid into a gas flow for rapid evaporation.

It is another object of the invention to provide a humidification system that is capable of adding liquid to a gas flow travelling at any of a wide range of speeds.

It is still another object of the invention to provide a humidification system that minimizes raining in surrounding duct work.

It is a further object of the invention to reduce the quantity of larger, less evaporative droplets in a mist that are picked up by a passing flow.

It is yet another object of the invention to provide a humidification system that is modular for stacked arrangement in flow channels, such as air conditioning duct work.

These and other objects of the invention are achieved by a humidification system that reduces large water droplet carryout by reducing the speed of a flow of gas, such as air, diverted from a larger stream and routed to the humidification system. The system can include a housing for a mist source. The housing provides an inlet port that has a smaller cross-sectional area than a humidifying chamber within the housing, resulting in a reduction in air speed as the flow enters the housing. The reduced flow speed reduces the quantity of larger, less evaporative droplets picked up from the mist and provides a more efficient evaporation of the smaller droplets. The humidified gas then is reintroduced to the larger, surrounding flow through an exhaust port in the housing.

For humidification using mist generators that create columns of water droplets, such as ultrasonic transducers, the quantity of larger droplets picked up can be further reduced by dividing the humidifying chamber with a plate. Preferably, one plate divides the humidifying chamber into two subchambers. The inlet port can provide for air to enter above and below the plate. Apertures are placed in the plate to provide for the passage of water column such that water droplets can travel to the upper region above the plate. The chamber division and the plate apertures create an upwardly directed vertical flow through the aperture that allows for the collection of moisture while at the same time reducing large water droplet carryout due to the effects of gravity on the water droplets and other factors.

The exhaust port can be disposed in the upper chamber to readily exhaust the flow from the upper chamber carrying the smaller droplets. The flow in the lower chamber is routed to increase the expulsion of larger droplets picked up in the lower chamber by curved travel through the apertures and a slot at the exhaust end of the plate. The slot can also permit water collected in the upper chamber to drain to the lower chamber and the enclosed reservoir.

The humidification system can further provide shields to divert the air flow from direct, splattering contact with the mist source. Further, the shields can be used to retard water splatter from leaving through the inlet and outlet ports.

The humidification system can also provide various deflectors for capturing water droplets in the exhausting air flow and for routing the flow in a tortious path to increase expulsion of larger water droplets.

Thus, the humidification system provides a series of elements for reducing the quantity of larger less evaporative droplets in the air flow, thereby permitting efficient humidification of gas streams of varying speeds with increased evaporation effectiveness.

BRIEF DESCRIPTION OF THE DRAWINGS

A more thorough understanding of the invention and its preferred embodiments can be gained from a reading of the following detailed description in connection with the accompanying drawing, in which:

FIG. 3 is a side sectional view of an air conditioning duct utilizing the humidifier of FIG. 1 in a horizontal air flow; and FIG. 4 is a side sectional view of an air conditioning duct utilizing the humidifier of FIG. 1 in a vertical air flow.

DETAILED DESCRIPTION OF THE INVENTION

The invention relates to humidifiers and generally provides apparatus for producing a mist of liquid for introduction to a stream of gas flowing at any of a wide range of velocities. The humidification system of the invention is capable, for example, of adding moisture to a stream of air in an air conditioning system travelling in air conditioning system duct work at speeds as low as 100 feet per minute and as high as 2,000 feet per minute.

A primary application for the humidification system of the invention is the humidification of air streams in systems for heating, cooling, filtering, and other environmental processing. Accordingly, details of preferred embodiments of the invention are set forth herein with particular reference to this application. However, the features of the invention can be used in a variety of other environments in which it is desired to introduce a mist of liquid to a gaseous stream for evaporation of the liquid in the gaseous stream. Such applications can include chemical processes in which the liquid mist is other than water and the gaseous stream is other than air. The liquid mist could also include liquids that are suspended in a gaseous medium, such as an aerosol spray.

The invention also contemplates other air conditioning applications in which aerosols, deodorants, fragrances, or other additives are introduced to the air stream in addition to water. Thus, humidification is referenced in its broadest sense to include the addition of any liquid to a gaseous flow, and the scope of the invention should not be considered to be limited to the introduction of a pure water mist to an air conditioning air flow.

Figure 1:
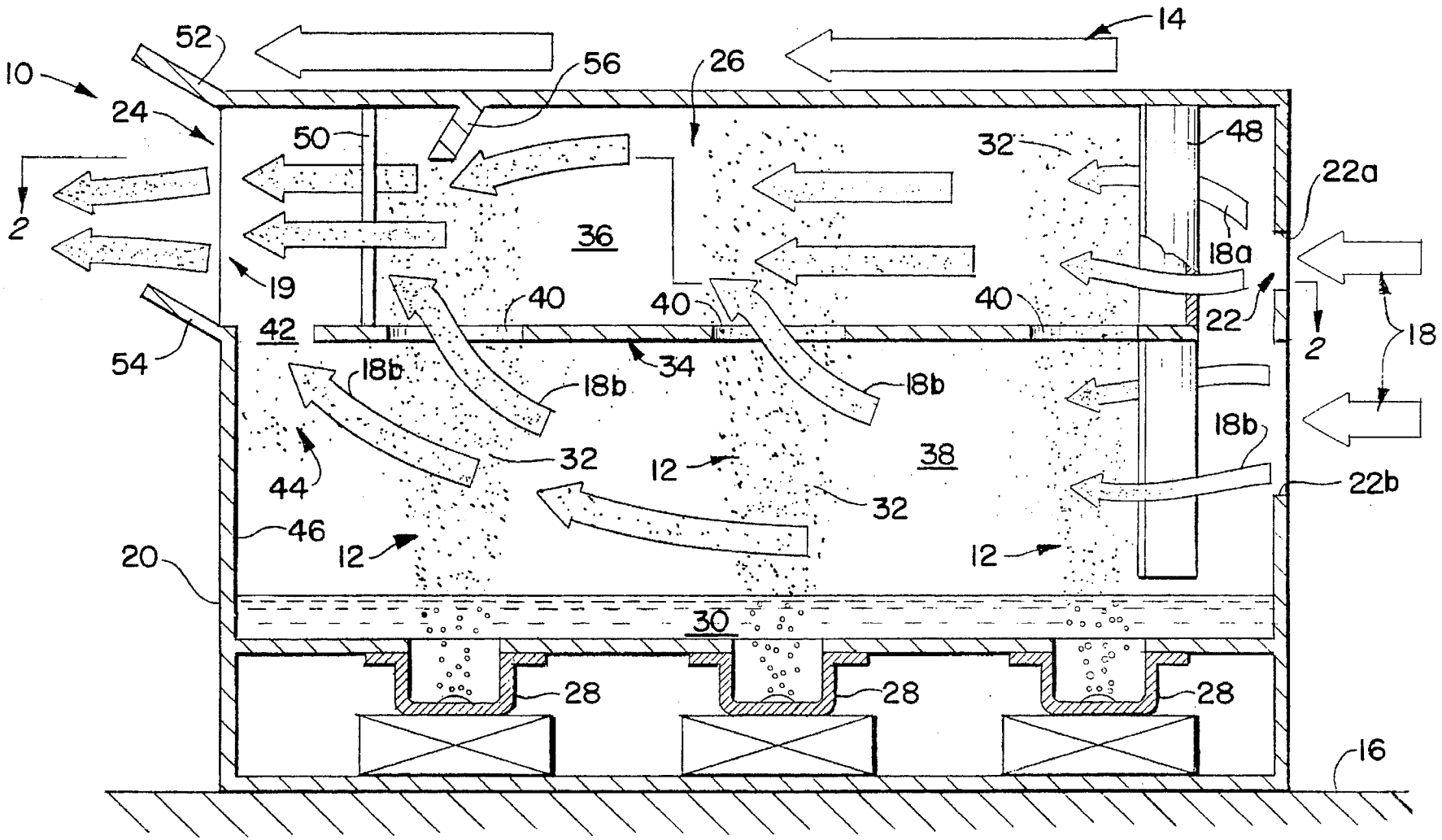
FIG. 1 is a side sectional view of a preferred humidifier according to the invention.

Referring to the drawings and particularly to FIG. 1, a preferred humidifier 10 is capable of effectively and efficiently producing a liquid mist 12 for evaporation in an air stream 14 in a larger system, such as an air conditioning system duct 16. The air stream 14 in the duct 16 can have any of a wide range of speeds. The humidifier 10 is capable of adding evaporative moisture to the air stream 14 by providing a series of mechanisms for reducing the quantity of larger, less evaporative water droplets in the liquid mist 12 introduced to an air flow 18 diverted from the larger air stream 14 and passed within the humidifier 10.

The humidifier 10 provides a system for controlling the volume of air flow 18 that is presented to the liquid mist 12 and for controlling the speed of this volume of air flow 18 as it interfaces with the liquid mist 12. When the air flow 18 interfaces with the liquid mist 12 at a relatively slower speed than the air stream 14 in the surrounding duct 16, the larger water droplets in the liquid mist 12 have a greater opportunity to fall out of the air flow 19 due to gravity and other factors before the humidified air flow 18 is reintroduced to the larger air stream 14. By reducing the quantity of larger water droplets that are collected, the rate and efficiency of evaporation of the liquid mist 12 in the air flow 18 is increased and raining and moisture collection on the walls of the larger system are reduced or eliminated.

In the illustrated preferred embodiment, the humidifier 10 generally includes a housing 20 having an inlet port 22, an exhaust port 24 and defining a humidifying chamber 26 which contains a mist generator 28 or mist source, such as one or more ultrasonic transducers that cavitate water in a reservoir pool 30 into columns of water droplets, also referred to as water fingers 32. The transducers can be oriented to project the water fingers 32 at an incline of preferably 7°. The transducer closest to the inlet port 22 is preferably sloped at an incline of 7° away from the inlet pore. The humidifying chamber 26 can be any shape, such as hexagonal, rectangular, round, square or triangular.

The inlet port 22 allows a portion of the air stream 14 to enter the humidifying chamber 26 and serves to control the volume of air diverted from the air stream 14 and presented to the liquid mist 12. The exhaust port 24 allows the air flow 18 to exit the humidifying chamber 26 for reintroduction to the air stream 14.

The cross-sectional area of the humidifying chamber 26 is preferably larger than the cross-sectional area of inlet port 22. The larger cross-sectional area of the humidifying chamber 26 provides for a corresponding reduction in the air speed as the air flow 18 enters the humidifying chamber 26. The cross-sectional area of inlet port 22 and exhaust port 24 can also be sized to minimize larger liquid droplet carryout by controlling the volume of air entering the humidifying chamber 26 and the speed of air through the humidifying chamber 26.

Thus, the humidifier air flow 18 is temporarily slowed relative to the larger air stream 14 in the surrounding duct 16. Larger water droplets are not as readily picked up by the slower air flow 18 and are provided a greater opportunity to fall out by gravity or the slinging effect of tortuous flow within the humidifying chamber 26. As a result, the quantity of larger, less evaporation water droplets introduced into the air stream 14 is reduced.

The inlet port 22 and the exhaust port 24 are preferably positioned on opposing walls of the housing but can be positioned on any wall of the housing. The inlet port 22 and the exhaust port 24 can be any shape, such as hexagonal, rectangular, round, square or triangular.

The humidification system can include any of a variety of mist generators or mist sources. While the preferred embodiment disclosed utilizes one or more high frequency, ultrasonic transducers 28 for cavitating water in the reservoir pool 30 into upwardly directed water fingers 32, the humidifier 10 can use other mist generators, including atomizers, nebulizers, vibrators and steam generating heaters. Generally, the mist generator can be any device or system that presents a mist of liquid for pick up by a passing gas flow.

The humidifier 10 preferably includes a plate 34 for dividing the humidifying chamber 26 into an upper subchamber 36 and a lower subchamber 38. In this embodiment, the inlet port 22 can include an upper opening **22*a* to the upper subchamber 36 and a lower opening 22*b* to the lower subchamber 38**.

This plate division is particularly suited for use with transducers that produce water fingers of liquid mist. The water fingers 32 produced by cavitating transducers 28 typically contain water droplets that extend upwardly and outwardly in mushroom fashion.

The chamber division created by the plate 34 further reduces the quantity of larger water droplets that remain in the air flow 18 exiting through the exhaust port 24. Apertures 40 in the plate 34 allows extension of each water finger 32 through the plate 34. The air flow **18*a* introduced to the upper opening 22*a* interfaces primarily only with the liquid droplets in the upper subchamber 36 while the air flow 18*b* introduced to the lower opening 22*b* interfaces with both the liquid droplets in the upper subchamber 36 as well as the lower subchamber 38**.

The air flow 18 introduced to the lower subchamber 38 through the lower opening **22*b* of the inlet port 22 may capture larger, less evaporative water droplets but is routed to increase the expulsion of these water droplets. First, the lower subchamber air flow 18*b* is generally upwardly directed through the apertures 40. The curvilinear direction of this lower subchamber flow 18*b* slings some of the larger water droplets from the air flow 18*b* during the transition to the upper subchamber 36**.

A slot 42 is preferably provided at the exhaust end of the plate 34 for allowing the further transfer of air flow **18*b* from the lower subchamber 38. As air flow 18*b* in the lower subchamber 38 is directed towards this slot 42, a portion of the larger water droplets 44 impact the exhaust side wall 46 of the lower subchamber 38, thereby collecting on the wall 46 and returning to the reservoir pool 30. Preferably, the plate 34 extends to the inlet shield 48**.

These mechanisms reduce the collection of larger water droplets in addition to the speed reduction of the air flow 18 in both the upper subchamber 36 and lower subchamber 38. The plate 34 allows the air flow 18 to maximize the amount of moisture collected while simultaneously reducing the quantity of larger, less evaporative liquid droplets collected by the air flow 18.

If the housing 20 is made sufficiently high, the plate 34 could be omitted while still accomplishing a similar separation effect by routing air flow 18 in a generally upwardly directed path to the upper region to capture moisture. Independent of the construction for generating vertical flow, the vertical routing of air flow results in a more compact housing longitudinally.

According to another aspect of the invention, the quantity of larger water droplets collected and splattered from impact of the air flow 18 with the liquid mist 12 can be reduced by deflecting or re-routing the interfacing air flow 18 from a direct impact with the liquid mist 12. The inlet shield 48 can be positioned between the inlet port 22 and the liquid mist 12 to function as both an air diverter and a liquid catch. An exhaust shield 50 can serve as a catch for preventing liquid droplets in the liquid mist 12 that are propelled or ricocheted from the liquid mist 12 from escaping the humidifier 10 and being introduced to the larger air stream 14.

Figure 2:
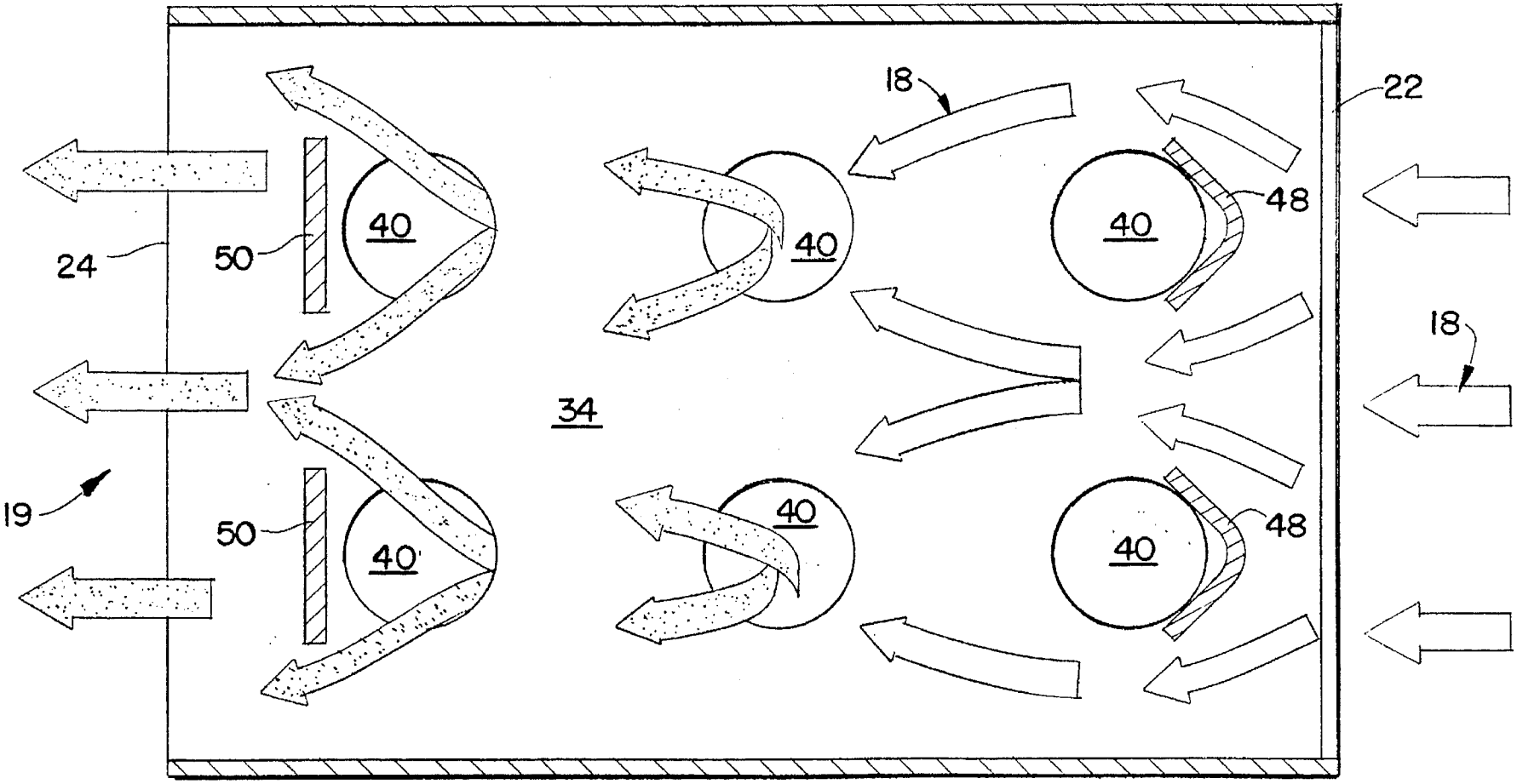
FIG.2 is a top sectional view of the humidifier of FIG. 1 along the section line 2—2.

Referring to FIG. 2, as an air diverter, the inlet shield 48 can be positioned to divert the air flow 18 away from a path impinging directly on the water fingers (not shown) extending through the apertures 40. The re-routing of the air flow 18 from direct impact further reduces the quantity of larger water droplets that would otherwise be picked up by a more rapid interface with a direct air flow 18. With the diversion by the inlet shields 48, the air flow 18 interacts with the liquid mist in a more tangential and resultingly slower manner, thereby collecting less of the larger water droplets.

As a catch, the inlet shield 48 can also serve to capture liquid droplets that may ricochet from the water finger toward inlet port 22 during impact with the passing air flow 18. The inlet shield 48 is preferably V-shaped with its apex directed toward inlet port 22. The exhaust shield 50 is preferably rectangular shaped. Alternatively, the inlet shield 48 can be hexagonal, rectangular, round, square or triangular shaped. Alternatively, the exhaust shield 50 can be hexagonal, round, square, triangular or V-shaped. In general, the inlet shield 48 and exhaust shield 50 can be any geometric shape that functions to divert the air flow 18 from direct impact with the liquid mist and to retard the liquid mist from exiting the humidifier 10 through the inlet port 22 and exhaust port 24.

To further reduce the quantity of larger liquid droplets collected, the humidifier preferably includes various deflectors for capturing and retarding the passage of any larger liquid droplets that may exist in the air flow exhausting from the humidifier, despite the limiting effects of the air speed reduction shield diversion and chamber division.

Referring again to FIG. 1, an upper exhaust deflector 52 and a lower exhaust deflector 54 are adjacent to the external side of the exhaust port 24 for deflecting larger liquid droplets back into the humidifying chamber 26. By positioning the lower exhaust deflector 54 at an angle, larger liquid droplets that are not evaporated by the air flow 18 can be caught by the lower exhaust deflector 54 and trickle back into the humidifying chamber 26 or more specifically into the reservoir pool 30 through the slot 42 in the plate 34.

The internal deflector 56 forces air into a tortious flow that further slings larger water droplets out of the air flow 18 for return to the reservoir pool 30.

The upper exhaust deflector 52 is also positioned at an angle to capture large liquid droplets. Large liquid droplets that come into contact with the upper exhaust deflector 52 will generally slide back into the humidifying chamber 26 and then fall into the reservoir pool 30 through the slot 42 in the plate 34.

In certain embodiments of the invention, the humidifier can be used within an enclosure separate from an air conditioning system. The humidifier can provide its own air flow generator, such as a fan, for driving the air stream through the liquid mist.

As shown in FIG. 3, the humidifier can be placed in an air conditioning duct 16 where the cross-sectional area of the humidification system housing 20 is smaller than the cross-sectional area of the air conditioning duct 16. In this arrangement, the humidification system takes a portion of the air from the air conditioning duct 16, introduces the air into the humidifying chamber, slows the air flow down while adding moisture to the air, and then reintroduces the air into the air conditioning duct. The air exiting the humidification system is then diffused into the larger air stream 14 to create a consistent moisture level within the air stream 14 in the air conditioning duct 16. The preferred humidifier and its compact housing 20 allow for the control of the humidity level within the surrounding air stream 14 by modular arrangement of a plurality of the humidifiers. Typically, arranging these humidification systems across an air conditioning duct 16 will be limited by the width of the air conditioning duct 16. However, the humidification system of the present invention provides for the stacking of these systems, one on top of the other, as well as spacing these systems in a serial arrangement. The stacking of these systems, one top of the other, allows for as little or as much of the air stream 14 to become humidified.

FIG. 4 highlights yet another example of the versatility of the compact housing of the humidifier, which allows the system to be placed in any orientation relative to the air stream flow within an air conditioning duct 16, including a vertical air flow 18. The humidification system with a scoop 58 directing air into the inlet port 22. A scoop 58 at the exhaust port 24 is not required since the air stream 14 pushes the air downward, as indicated by the arrows in FIG. 4. Further, if the humidification system is oriented at an angle relative to incoming air stream 14, a scoop 58 at the inlet port 22 can be used to direct the air into the humidification system. Additionally, the rapid change in angle as the air stream 14 exits the exhaust port 24 can create a slinging effect which will reduce the amount of large water droplet carryout.

Further, the humidifier can also be utilized in situations where an air conditioning duct 16 or air conditioning unit is not present. For instance, the humidification system can be used as a stand alone system for use in a bedroom, classroom, storage room or other enclosure in combination with a fan. The fan is utilized to generate, an airstream instead of an air conditioning unit. The basic function of the fan is to provide a gas flow through the humidifier.

The detailed description of embodiments of the invention provides various means for reducing large liquid droplets in an effective and efficient manner. Alternative constructions within the scope of the invention will now likely be apparent to those skilled in the relevant art. For example, the housing can have a variety of lengths to accommodate as little as one mist generator to perhaps several dozen. Accordingly, the scope of the invention should not be limited by this detailed description but should be assessed by a reasonable interpretation of the claims.

I claim:

1. A humidifier for providing a liquid mist in a gas flow, said humidifier comprising:

a housing having an inlet port for receiving the gas flow into humidifying chamber and an exhaust port for exhausting the gas flow from said humidifying chamber, wherein the cross-sectional area of the humidifying chamber is larger than the cross-sectional area of the inlet port, whereby the velocity of the gas flow is reduced upon entering the humidifying chamber; an ultrasonic transducer positioned in a pool of liquid to interface the reduced velocity gas flow; and at least one plate extending substantially across said humidifying chamber above said ultrasonic transducer, said plate dividing the chamber into at least two subchambers, said plate providing at least one aperture for permitting the passage of a substantially vertically extending fluid finger produced by the ultrasonic transducer, said inlet port permitting entry of the gas flow above and below said plate.

2. The humidifier according to claim 1, wherein the liquid is water.

3. A humidifier for providing a liquid mist in a gas flow, said humidifier comprising:

a housing having an inlet port for receiving the gas flow into humidifying chamber and an exhaust port for exhausting the gas flow from said humidifying chamber, wherein the cross-sectional area of the humidifying chamber is larger than the cross-sectional area of the inlet port, whereby the velocity of the gas flow is reduced upon entering the humidifying chamber;

a liquid mist generator for producing a liquid finger and positioned to interface the reduced velocity gas flow; and an inlet shield positioned between the inlet port and the liquid mist generator, said inlet shield capturing droplets that may ricochet from the liquid finger towards the inlet port.

4. The humidifier according to claim 3, wherein the inlet shield is positioned to divert the gas flow away from a path impinging directly on the liquid finger.

5. The humidifier according to claim 3, wherein the liquid mist generator includes a plurality of ultrasonic transducers for variability.

6. The humidifier according to claim 3, wherein the inlet shield is V-shaped with the apex of the V directed towards the inlet port and the exhaust shield is rectangular shaped and adjacent to the exhaust port.

7. A humidifier system for providing a liquid mist in a gas flow in an air conditioning environment, said humidifier system comprising:

a housing having an inlet port for receiving the gas flow into humidifying chamber and an exhaust port for exhausting the gas flow from said humidifying chamber, wherein the cross-sectional area of the humidifying chamber is larger khan the cross-sectional area of the inlet port, whereby the velocity of the gas flow is reduced upon entering the humidifying chamber;

a liquid mist generator positioned within the humidifying chamber to interface the reduced velocity gas flow;

a scoop connected to the inlet port for diverting the gas flow at an angle into said inlet port;

an upper exhaust deflector adjacent the upper external side of the exhaust port for deflecting larger droplets back into the humidifying chamber and a lower exhaust deflector adjacent the lower external side of the exhaust port for deflecting larger droplets back into the humidifying chamber; and an air conditioning duct surrounding said housing and having a larger cross-sectional area than the housing of the humidifier.

8. The humidifier according to claim 7 further comprising an air conditioning unit having a cooling coil wherein said inlet port is adjacent to said cooling coil.

9. The humidifier according to claim 7, further comprising a blower for directing forced gas flow past the liquid mist generator.

10. The humidifier according to claim 7, wherein said inlet port and said exhaust port are positioned in parallel to each other and in different planes.

11. The humidifier according to claim 7, wherein the liquid mist generator is selected from the group consisting of a nebulizer, atomizer, ultrasonic transducer and ultrasonic vibrator.

12. The humidifier system according to claim 7, wherein the scoop is shaped to divert the gas flow transversely into said inlet port.

13. The humidifier system according to claim 7, wherein he scoop is removable.

14. A humidifier system for providing a liquid mist in a gas flow in an air conditioning environment, said humidifier system comprising:

a plurality of housings, each having an inlet port for receiving the gas flow into humidifying chamber and an exhaust port for exhausting the gas flow from said humidifying chamber, wherein the cross-sectional area of the humidifying chamber is larger than the cross-sectional area of the inlet port, whereby the velocity of the gas flow is reduced upon entering the humidifying chamber;

a liquid mist generator in each humidifying chamber, each positioned to interface the reduced velocity gas flow;

a scoop connected to the inlet port of each of said housings for diverting the gas flow at an angle into said inlet port;

an upper exhaust deflector adjacent the upper external side of each exhaust port for deflecting larger droplets back into the humidifying chamber and a lower exhaust deflector adjacent the lower external side of each exhaust port for deflecting larger droplets back into-the humidifying chamber; and an air conditioning duct surrounding said housings and having a larger cross-sectional area than the housings.

* * * * *